US008790154B2

(12) United States Patent
Blackwell

(10) Patent No.: US 8,790,154 B2
(45) Date of Patent: Jul. 29, 2014

(54) POST-OPERATIVE COMPRESSION BRA

(76) Inventor: Lea M. Blackwell, Fort Myers, FL (US)

( * ) Notice: Subject to any disclaimer, the term of this patent is extended or adjusted under 35 U.S.C. 154(b) by 273 days.

(21) Appl. No.: 13/289,016

(22) Filed: Nov. 4, 2011

(65) Prior Publication Data

US 2013/0115852 A1 May 9, 2013

(51) Int. Cl.
*A41C 3/00* (2006.01)

(52) U.S. Cl.
CPC ..... *A41C 3/0064* (2013.01)
USPC ..... 450/86; 450/58

(58) Field of Classification Search
USPC ..... 450/9, 10, 15, 17, 26, 28, 71, 79, 72, 450/73, 54, 58, 36, 37, 86
See application file for complete search history.

(56) References Cited

U.S. PATENT DOCUMENTS

| | | | | | |
|---|---|---|---|---|---|
| 2,662,522 | A | | 12/1953 | Muller | |
| 3,561,442 | A | * | 2/1971 | Goswitz | 602/41 |
| 3,698,399 | A | * | 10/1972 | Hand | 450/59 |
| 3,968,803 | A | | 7/1976 | Hyman | |
| 4,369,792 | A | | 1/1983 | Miller | |
| 4,804,351 | A | | 2/1989 | Raml et al. | |
| 4,949,436 | A | * | 8/1990 | Anscher | 24/671 |
| 5,081,718 | A | * | 1/1992 | Carman et al. | 2/227 |
| 5,152,741 | A | | 10/1992 | Farino | |
| 5,158,541 | A | | 10/1992 | McCurley | |
| 5,257,956 | A | | 11/1993 | Ewen | |
| 5,429,593 | A | * | 7/1995 | Matory | 602/79 |
| 5,527,270 | A | | 6/1996 | Chase et al. | |
| 5,839,942 | A | | 11/1998 | Miller | |
| 5,871,388 | A | * | 2/1999 | Lambert | 450/58 |
| 6,168,498 | B1 | * | 1/2001 | Wagner | 450/58 |
| 6,233,793 | B1 | * | 5/2001 | Wanzenbock | 24/615 |
| D446,629 | S | | 8/2001 | Swanger | |
| 6,390,885 | B1 | * | 5/2002 | Brooks | 450/1 |
| 6,755,717 | B2 | * | 6/2004 | Smith | 450/1 |
| 6,793,556 | B1 | * | 9/2004 | Fildan et al. | 450/58 |
| 6,860,789 | B2 | | 3/2005 | Bell et al. | |
| D503,509 | S | | 4/2005 | Bell et al. | |
| 6,936,021 | B1 | | 8/2005 | Smith | |
| 7,144,294 | B2 | * | 12/2006 | Bell et al. | 450/20 |
| 7,192,409 | B2 | * | 3/2007 | Lorenzo | 602/19 |
| 7,445,541 | B2 | | 11/2008 | Patterson | |
| 7,549,971 | B2 | * | 6/2009 | Bell et al. | 602/75 |
| 7,775,851 | B2 | * | 8/2010 | Sgro | 450/79 |
| 7,909,675 | B1 | | 3/2011 | Rainey | |
| 7,922,682 | B2 | | 4/2011 | Bell et al. | |
| 2005/0112996 | A1 | * | 5/2005 | Buehler | 450/58 |
| 2011/0318990 | A1 | * | 12/2011 | Bodnar | 450/58 |

* cited by examiner

*Primary Examiner* — Gloria Hale
(74) *Attorney, Agent, or Firm* — The Livingston Firm; Edward M. Livingston, Esq.; Bryan L. Loeffler, Esq.

(57) ABSTRACT

A post-operative compression bra (1) having an opening located between two portions, a front right portion (2) and a front left portion (3) that are secured together using strap clips (9) that allow pressure being exerted by the bra on a patient to be adjusted. Rounded notches (19) are located on an upper edge (17) of a right side portion (12) and a left side portion (13) to prevent the side portions from coming into contact with a patient's lymph nodes. The side portions and a rear portion (20) may also be partially constructed out of a mesh material to allow for air flow to the skin.

3 Claims, 2 Drawing Sheets

POST-OPERATIVE COMPRESSION BRA

BACKGROUND OF THE INVENTION

This invention relates to compression garments and brassieres and, more particularly, a bra for providing compressive forces to a female torso and breasts to help eliminate or reduce swelling normally experienced after breast surgery.

Compression bras are used for patients who have undergone breast augmentation or reduction, reconstructive surgery, mastectomies and so forth. Compression bras apply compression on the surface of the patient's skin to reduce the physical volume of the breasts and surrounding areas, thereby reducing the effects of swelling and bruising commonly experienced after surgery. Conventional compression bras typically fasten in the front using a hook and loop fastener that can scratch the skin and fail to provide an easy means for adjusting the amount of pressure exerted on a patient by the bra. An additional problem with the design of conventional compression bras is that a seam is located down the middle of each cup that rubs against the nipple and causes irritation to the patient. An even further problem with conventional bras is the side straps that wrap around the torso press against patients' lymph nodes located under the armpits, an area where incisions are commonly made during breast surgery, thereby causing further discomfort to the patient.

Therefore, a need exists for an ergonomic post-operative compression bra that reduces the effects of swelling and bruising commonly experienced after breast surgery while not causing any discomfort normally experienced with conventional post-operative compression bras.

The relevant prior art includes the following references:

| Pat. No. (U.S. Patent References) | Inventor | Issue/ Publication Date |
|---|---|---|
| 7,922,682 | Bell et al. | Apr. 12, 2011 |
| 7,909,675 | Rainey | Mar. 22, 2011 |
| 7,445,541 | Patterson | Nov. 04, 2008 |
| 6,936,021 | Smith | Aug. 30, 2005 |
| D503,509 | Bell et al. | Apr. 05, 2005 |
| 6,860,789 | Bell et al. | Mar. 01, 2005 |
| D446,629 | Swanger | Aug. 21, 2001 |
| 5,839,942 | Miller | Nov. 24, 1998 |
| 5,527,270 | Chase et al. | Jun. 18, 1996 |
| 5,257,956 | Ewen | Nov. 02, 1993 |
| 5,158,541 | McCurley | Oct. 27, 1992 |
| 5,152,741 | Farino | Oct. 06, 1992 |
| 4,804,351 | Raml et al. | Feb. 17, 1989 |
| 4,369,792 | Miller | Jan. 25, 1983 |
| 3,968,803 | Hyman | Jul. 13, 1976 |
| 2,662,522 | Muller | Dec. 15, 1953 |

SUMMARY OF THE INVENTION

The primary object of the present invention is to provide a post-operative compression bra that reduces the effects of swelling and bruising commonly experienced after breast surgery while not causing any discomfort normally experienced with conventional post-operative compression bras.

An additional object of the present invention is to provide a post-operative compression bra that allows a patient or caregiver to easily adjust the amount of pressure exerted on a patient by the bra.

An even further object of the present invention is to provide a post-operative compression bra having notches located on the side straps that prevent the bra from pressing against patients' lymph nodes located under the armpits.

The present invention fulfills the above and other objects by providing a post-operative compression bra having an opening located between a front right portion and a front left portion that are secured together using strap clips that allow the pressure being exerted on a patient to be adjusted. Rounded notches are located on an upper edge of a right side portion and a left side portion to prevent the side portions from coming into contact with a patient's lymph nodes. The side portions and a rear portion may also be partially constructed out of a mesh material to allow for air flow to the skin.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
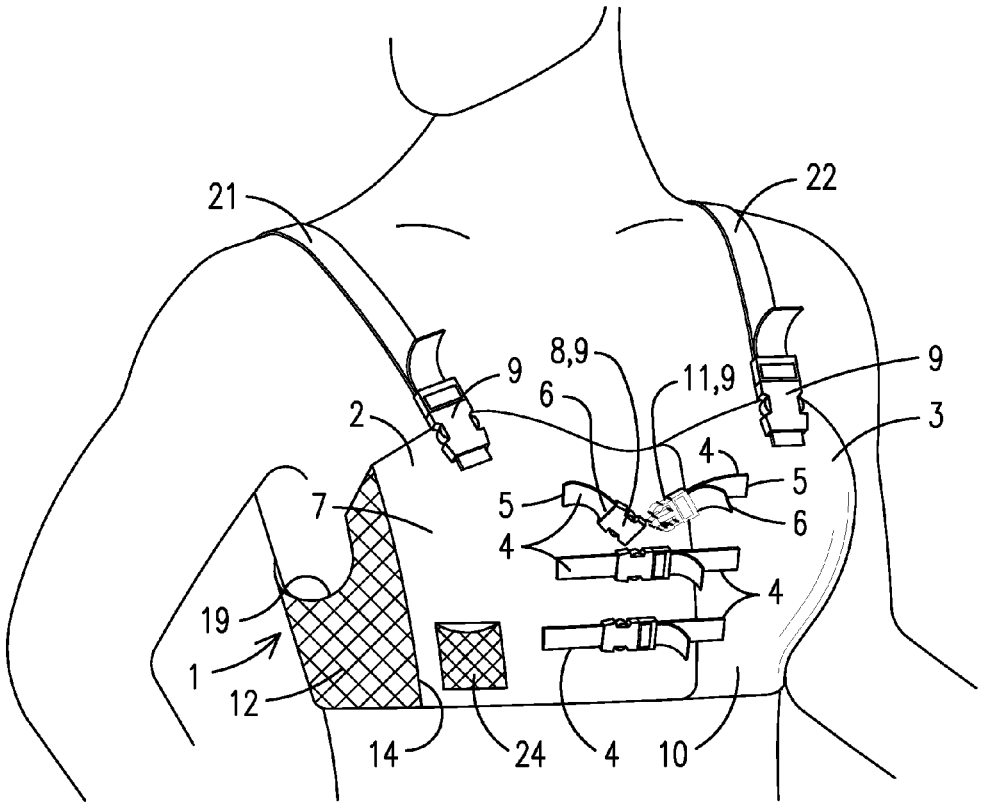
FIG. 1 is a front perspective plan view of a post-operative compression bra of the present invention being worn by a patient.
Figure 2:
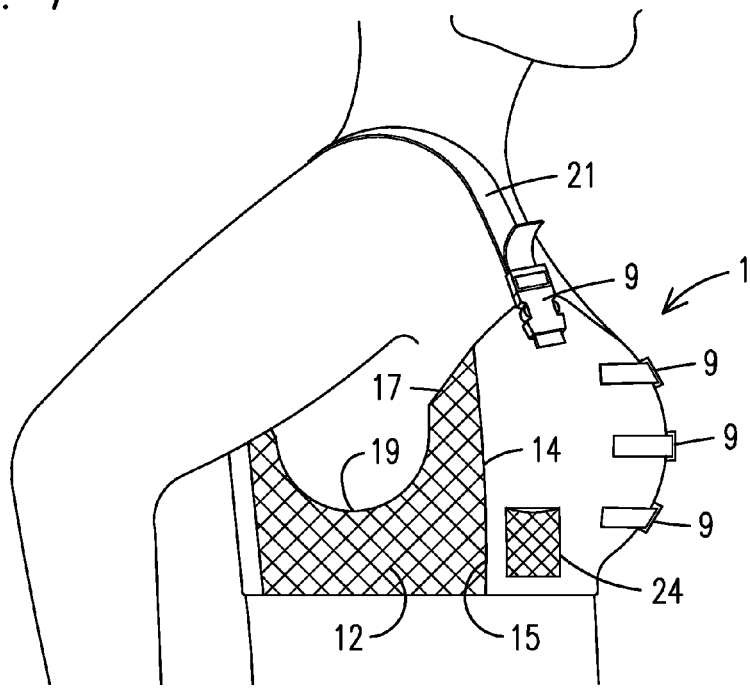
FIG. 2 is a side view of a post-operative compression bra of the present invention being worn by a patient.
Figure 3:
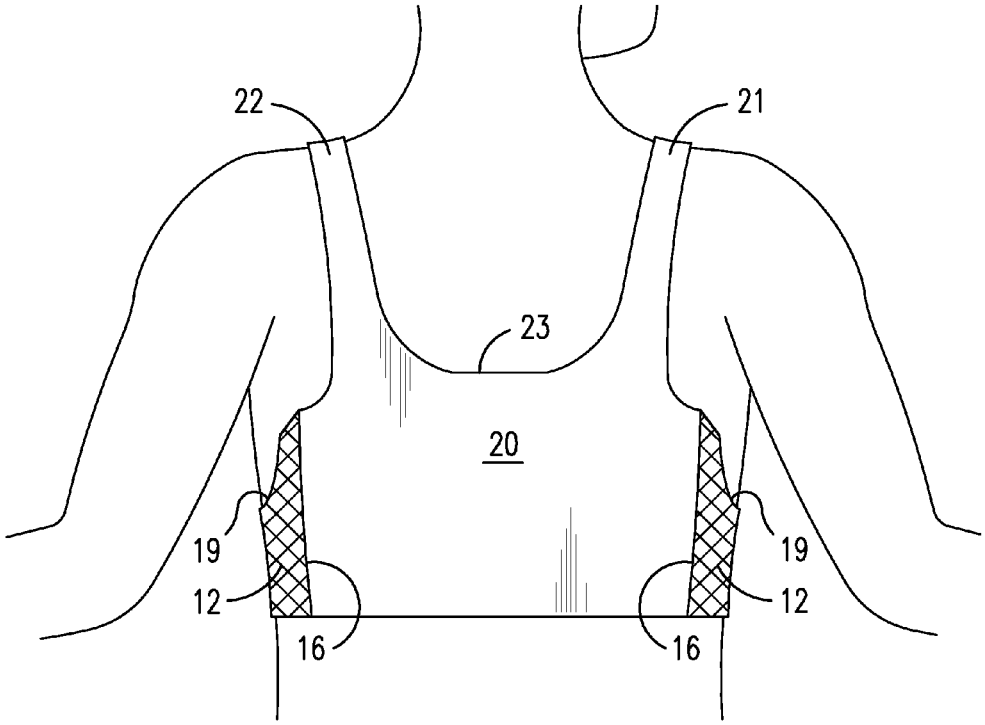
FIG. 3 is a rear view of a post-operative compression bra of the present invention being worn by a patient.

For purposes of describing the preferred embodiment, the terminology used in reference to the numbered accessories in the drawings is as follows:

1. post operative compression bra
2. front right portion
3. front left portion
4. attachment strap
5. proximal end
6. distal end
7. front surface of front right section
8. female portion
9. strap clip
10. front surface of front left section
11. male portion
12. right side portion
13. left side portion
14. outer edge of front portion
15. front edge of side portion
16. rear edge of side portion
17. upper edge of side portion
18. lower edge of side portion
19. notch
20. rear portion
21. right shoulder strap
22. left shoulder strap
23. upper edge of rear portion
24. holding means
25. interior surface With reference to FIGS. 1, 2 and 3, a front perspective plan view of a post-operative compression bra 1 of the present invention being worn by a patient, a side view of a post-operative compression bra 1 of the present invention being worn by a patient and a rear view of a post-operative compression bra 1 of the present invention being worn by a patient, respectively, are illustrated. The post-operative compression bra 1 comprises a front right portion 2 and a front left portion 3 that are worn over the patient's breasts. At least one attachment strap 4 having a proximal end 5 and a distal end 6 is attached at the proximal end 6 to a front surface 7 of the front right section 2. A female portion 8 of a strap clip 9 is attached to the distal end 6 of the at least one strap 4 that is attached to the front right portion 2. At least one attachment strap 4 having a proximal end 5 and a distal end 6 is attached at the proximal end 5 to a front surface 10 of the front left portion 3. A male portion 11 of a strap clip 9 is attached to the distal end 6 of the at least one attachment strap 4 that is attached to the front left portion 3. When the front right portion 2 and front left portion 3 are secured together using strap clips 9 a portion of the front left portion 3 rests under a portion of the right front portion 2 to separate the patient's skin from the strap clips 9 and to provide extra cushioning between the patient's skin and the strap clips 9. The strap clips 9 also allow a patient or caregiver to tighten or loosen the post-operative compression bra 1 by pulling on the distal end 6 of the at least one attachment strap 4 without separating the right front portion 2 from the left front portion 3, as would be necessary with conventional bras using hook and loop fastener as an attachment means.

A right side portion 12 and a left side portion 13 extend from an outer edge 14 of the right front portion 2 and the left front portion 3, respectively, around sides of the patient's torso. The side portions 12, 13 each comprise a front edge 15, rear edge 16, upper edge 17 and lower edge 18. The side portions are preferably constructed out of a breathable mesh material 19 that allows airflow to the patient's skin. The upper edges 17 of each side portion 12, 13 curve s downward toward the lower edges to create substantially C-shaped notches 19, thereby preventing the side portions 12, 13 from coming into contact with a patient's lymph nodes.

A rear portion 20 is located between the rear edges 16 of the side portions 12, 13. The rear portion 20 may be made of a cloth material and/or breathable mesh material that allow airflow to the patient's skin. A right shoulder strap 21 and left shoulder strap 22 extend from an upper edge 23 of the rear portion 19 over the patient's shoulders. The right shoulder strap 21 and the left shoulder strap 22 are preferably attached to the front right portion 2 and front left portion 3, respectively, by strap clips 9 that allow the shoulder straps 21, 22 to easily be attached and detached from the front portion 2, 3 and for the patient and/or caregiver to adjust the length of the shoulder straps 21, 22. A holding means 24, such as a pocket, strap and so forth, may also be located on the bra 1. The holding means 24 is for holding a Jackson-Pratt ("JP") drain.

Figure 4:
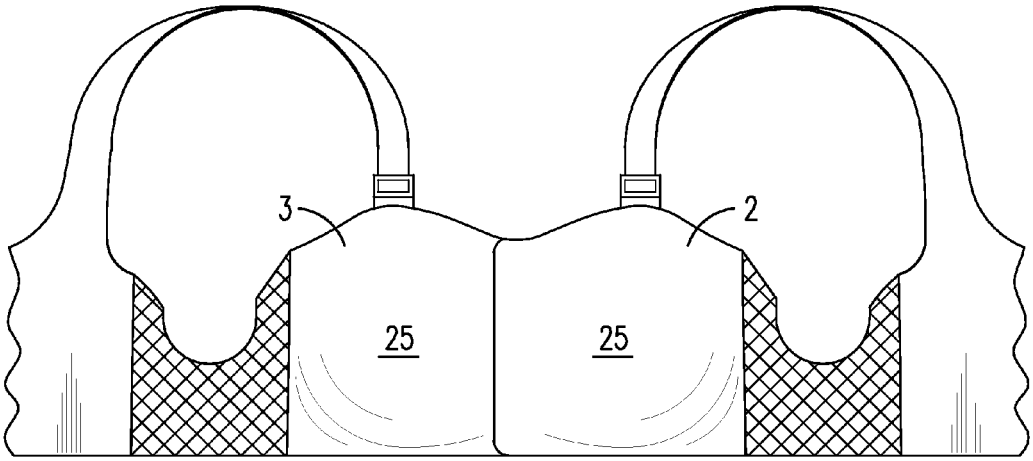
FIG. 4 is a partial cutaway interior view of the interior surface of a post-operative compression bra of the present invention.

With reference to FIG. 4, a partial cutaway interior view of the interior surface 25 of a post-operative compression bra of the present invention is illustrated showing a seamless interior surface 25. The interior surface 25 of the front right portion 2 and the front left portion 3 is smooth to prevent irritation of a patient's nipples.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A post-operative compression bra for reducing the effects of swelling and bruising commonly experienced after breast surgery, said post-operative compression bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left portion extending around a left side of a patient's torso and being attached to said rear portion;

at least one strap clip having a male portion with at least two prongs that are inserted into a female portion of the strap clip when inserted into said female portion of said strap clip to secure said male portion to said female portion to secure the front right portion to the front left portion, thereby securing the bra on the patient and stretching the front right portion and the left front portion across the right breast and left breast of the patient to provide compression; and at least one attachment strap adjustably attached to the post-operative compression bra and to the at least one strap clip so that when a distal end of the at least one attachment strap is pulled, a circumference of said post-operative compression bra is reduced, thereby compressing the front right portion and the left front portion against the right breast and left breast, respectively, of the patient;

a substantially C-shaped notch located on an upper edge of the right side portion; and a substantially C-shaped notch located on an upper edge of the left side portion.

2. A post-operative compression bra for reducing the effects of swelling and bruising commonly experienced after breast surgery, said post-operative compression bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left portion extending around a left side of a patient's torso and being attached to said rear portion;

at least one strap clip having a male portion with at least two prongs that are inserted into a female portion of the strap clip when inserted into said female portion of said strap clip to secure said male portion to said female portion to secure the front right portion to the front left portion, thereby securing the bra on the patient and stretching the front right portion and the left front portion across the right breast and left breast of the patient to provide compression; and at least one attachment strap adjustably attached to the post-operative compression bra and to the at least one strap clip so that when a distal end of the at least one attachment strap is pulled, a circumference of said post-operative compression bra is reduced, thereby compressing the front right portion and the left front portion against the right breast and left breast, respectively, of the patient;

a substantially C-shaped notch located on an upper edge of the right side portion and having a midway point aligned with a mid-axillary line of a wearer and being located below any hair bearing skin of the wearer's axilla; and a substantially C-shaped notch located on an upper edge of the left side portion and having a midway point aligned with a mid-axillary line of a wearer and being located below any hair bearing skin of the wearer's axilla.

3. A post-operative compression bra for reducing the effects of swelling and bruising commonly experienced after breast surgery, said post-operative compression bra comprising:

a front right portion worn over a patient's right breast and attached to a right side portion;

said right side portion extending around a right side of a patient's torso and being attached to a rear portion that extends across a back of the patient;

a front left portion worn over a patient's left breast and attached to a left side portion;

said left portion extending around a left side of a patient's torso and being attached to said rear portion;

at least one strap clip having a male portion with at least two prongs that are inserted into a female portion of the strap clip when inserted into said female portion of said strap clip to secure said male portion to said female portion to secure the front right portion to the front left portion, thereby securing the bra on the patient and stretching the front right portion and the left front portion across the right breast and left breast of the patient to provide compression; and at least one attachment strap adjustably attached to the post-operative compression bra and to the at least one strap clip so that when a distal end of the at least one attachment strap is pulled, a circumference of said post-operative compression bra is reduced, thereby compressing the front right portion and the left front portion against the right breast and left breast, respectively, of the patient;

a substantially C-shaped notch located on an upper edge of the right side portion and having a midway point aligned with a mid-axillary line of a wearer and being located below any hair bearing skin of the wearer's axilla;

said substantially C-shaped notch located on an upper edge of the right side portion curving upward from the midway point to an upper edge of the front right portion;

said substantially C-shaped notch located on an upper edge of the right side portion curving upward from the midway point to an upper edge of the rear portion;

a substantially C-shaped notch located on an upper edge of the left side portion and having a midway point aligned with a mid-axillary line of a wearer and being located below any hair bearing skin of the wearer's axilla;

said substantially C-shaped notch located on an upper edge of the left side portion curving upward from the midway point to an upper edge of the front left portion; and said substantially C-shaped notch located on an upper edge of the left side portion curving upward from the midway point to an upper edge of the rear portion.

* * * * *